US007922375B2

(12) United States Patent
Tatsukawa

(10) Patent No.: US 7,922,375 B2
(45) Date of Patent: Apr. 12, 2011

(54) VEHICLE LIGHTING DEVICE HAVING LIGHT TRANSMITTING MEMBER WITH ANNULAR MIRROR-FINISH

(75) Inventor: Masashi Tatsukawa, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 96 days.

(21) Appl. No.: 12/389,459

(22) Filed: Feb. 20, 2009

(65) Prior Publication Data

US 2009/0213607 A1 Aug. 27, 2009

(30) Foreign Application Priority Data

Feb. 22, 2008 (JP) ..... 2008-041334
May 29, 2008 (JP) ..... 2008-140974

(51) Int. Cl.
*F21V 7/06* (2006.01)
*F21V 13/04* (2006.01)

(52) U.S. Cl. ..... 362/516; 362/299; 362/302; 362/327

(58) Field of Classification Search ..... 362/511, 362/543–545, 520, 516, 249.02, 311.02, 362/311.06–311.1, 326–327, 241–248, 299–302, 362/517, 518
See application file for complete search history.

(56) References Cited

U.S. PATENT DOCUMENTS 2,683,394 A 7/1954 Polanyi et al.
2004/0257826 A1 12/2004 Tatsukawa
2006/0193137 A1* 8/2006 Chinniah et al. ..... 362/326

FOREIGN PATENT DOCUMENTS

DE 10 93 685 11/1960
EP 1 427 029 A2 6/2004
JP 2002-094129 A 3/2002
JP 2005-011704 A 1/2005
WO 2005/109071 A1 11/2005

OTHER PUBLICATIONS

English Machine Translation (Claims, Detailed Description) of Japanese Publication JP 2005-011704A previously filed by applicant with IDS filed Feb. 20, 2009.*
Extended European Search Report in counterpart European Application No. 09002442.3, dated Apr. 1, 2010.

* cited by examiner

*Primary Examiner* — Alan Cariaso
(74) *Attorney, Agent, or Firm* — Sughrue Mion, PLLC

(57) ABSTRACT

Light having entered a light transmitting member through a predetermined point on an optical axis undergoes internal reflection in a front surface perpendicular to the optical axis, then undergoes internal reflection again in a rear surface composed of a paraboloid of revolution having a focal point at a position of plane symmetry with the predetermined point, and then exits the front surface. A mirror-finished annular region around the optical axis in the front surface has an outer peripheral edge set to be near a position where the incident angle of the light emitted from the light emitting element is equal to a critical angle, and an inner peripheral edge near a position where the light having undergone internal reflection in the front surface enters a position immediately behind the outer peripheral edge in the rear surface.

6 Claims, 8 Drawing Sheets

VEHICLE LIGHTING DEVICE HAVING LIGHT TRANSMITTING MEMBER WITH ANNULAR MIRROR-FINISH

BACKGROUND OF THE INVENTION

1. Field of the Invention

The present invention relates to a vehicle lighting device constructed such that light emitted from a light emitting element such as a light emitting diode exits forward relative to the lighting device by means of a light transmitting member arranged on the front side of the lighting device.

2. Background Art

In the prior art, for example, as described in "Patent Document 1", a vehicle lighting device is known in which light emitted from a light emitting element that is arranged near a predetermined point on the optical axis extending in the forward and backward directions of the lighting device and that is directed in the forward direction of the lighting device exits forward relative to the lighting device by means of a light transmitting member arranged on the front side of the lighting device.

This vehicle lighting device is constructed such that light emitted from the light emitting element enters the light transmitting member, then undergoes internal reflection in the front surface, then undergoes internal reflection again in the rear surface, and then exits the front surface. At that time, a center region in the front surface of the light transmitting member is mirror-finished for the purpose of internal reflection of the light emitted from the light emitting element.

Further, "Patent Document 2" describes an optical apparatus constructed such that light emitted from the light emitting element enters the light transmitting member, then undergoes internal reflection in the front surface, then undergoes internal reflection again in the rear surface, and then exits the front surface, and that a center region in the front surface of the light transmitting member is formed in the shape of a convex lens so as to deflect the outgoing light having exited the light emitting element and reached the center region.

[Patent Document 1] JP-A-2005-11704

[Patent Document 2] JP-A-2002-94129

By adopting the configuration described above in "Patent Document 1", a vehicle lighting device can be constructed with a reduced thickness.

Nevertheless, in the vehicle lighting device described in "Patent Document 1", mirror finish is performed in the center region in the front surface of the light transmitting member. This causes a problem that a part of the light having exited the light emitting element and undergone internal reflection in the center region is not utilized as forward illuminating light and hence the utilization factor of the source light flux cannot satisfactorily be improved.

In contrast, as in the optical apparatus described above in "Patent Document 2", when a center region in the front surface of the light transmitting member is formed in the shape of a convex lens, almost the entirety of the light having exited the light emitting element and reached the front surface of the light transmitting member can be utilized as forward illuminating light. Thus, the utilization factor of the source light flux can satisfactorily be improved.

Nevertheless, in the optical apparatus described in "Patent Document 2", the position of the outer peripheral edge of the center region is set to be near a position where the incident angle of the light having exited the light emitting element and reached the front surface of the light transmitting member is equal to a critical angle. Thus, the fraction of the light that exits the center region increases, while the fraction of the light that undergoes internal reflection in the front surface of the light transmitting member and then undergoes internal reflection in the rear surface decreases. Thus, when this optical apparatus is used as a lighting device, the following problem arises.

That is, a light source image formed by the light that has undergone internal reflection in the front surface of the light transmitting member, then undergone internal reflection again in the rear surface, and then exited the front surface is small. In contrast, a light source image formed by the light having directly exited the center region in the front surface of the light transmitting member is large. Thus, a problem arises that when the fraction of the light that exits the center region is relatively excessive, the light distribution pattern formed on a virtual vertical screen located in front of the lighting device cannot be formed in the shape of a light distribution pattern having a high center luminosity.

SUMMARY OF THE INVENTION

One or more embodiments of the present invention provide a vehicle lighting device constructed such that light emitted from a light emitting element exits forward relative to the lighting device by means of a light transmitting member arranged on the front side of the lighting device, and that a light distribution pattern having a high center luminosity can be formed with a satisfactorily high utilization factor of the source light flux.

According to one or more embodiments of the present invention, the region where mirror finish is to be performed in the front surface of the light transmitting member is set to be a predetermined annular region having the center at the optical axis.

According to one or more embodiments of the present invention, the vehicle lighting device is provided with a light emitting element that is arranged in a vicinity of a predetermined point on an optical axis extending in forward and backward directions of the lighting device and that is directed in a forward direction of the lighting device, and a light transmitting member arranged on a front side of the lighting device relative to the light emitting element. Light emitted from the light emitting element enters the light transmitting member. The light enters the light transmitting member is reflected by an internal reflection on a front surface of the light transmitting member. The light reflected on the front surface of the light transmitting member is reflected by an internal reflection again in a rear surface of the light transmitting member. Then, the light reflected on the rear surface of the light transmitting member exits the front surface of the light transmitting member. The front surface of the light transmitting member is composed of a planar surface perpendicular to the optical axis. The rear surface of the light transmitting member is composed of a predetermined light reflection controlling surface formed by adopting as a reference surface a paraboloid of revolution having a focal point at a position of plane symmetry with the predetermined point with respect to the front surface of the light transmitting member. An annular region having the center at the optical axis in the front surface of the light transmitting member is mirror-finished. A position of an outer peripheral edge of the annular region is set on a vicinity of a position where an incident angle of the light having exited the light emitting element and reached the front surface of the light transmitting member is equal to a critical angle. A position of an inner peripheral edge of the annular region is set on a vicinity of a position where the light having exited the light emitting element and undergone internal reflection in the front surface of the light transmitting member enters a position immediately behind the outer peripheral edge of the annular region in the rear surface of the light transmitting member.

The type of "light emitting element" is not limited to a particular one. For example, a light emitting diode or a laser diode may be employed. Further, the shape and the size of a light emitting chip in the "light emitting element" are not limited to particular ones.

The detailed shape of the "predetermined light reflection controlling surface formed by adopting as a reference surface a paraboloid of revolution" is not limited to a particular one. For example, a surface composed of a paraboloid of revolution itself, a surface in which a plurality of reflector elements are formed on a paraboloid of revolution, or a surface composed of a deformed paraboloid of revolution may be employed.

The "mirror finish" indicates processing for realizing specular reflection. Obviously, the mirror finish may be achieved by surface treatment such as aluminum vapor deposition. Alternatively, for example, the mirror finish may be achieved by sticking a member having a mirror surface.

As shown in the configuration described above, the vehicle lighting device of the one or more embodiments of the present invention is constructed such that light emitted from a light emitting element that is arranged in a vicinity of a predetermined point on the optical axis extending in the forward and backward directions of the lighting device and that directs in the forward direction of the lighting device enters a light transmitting member arranged on the front side of the lighting device relative to the light emitting element, then undergoes internal reflection in the front surface, then undergoes internal reflection again in the rear surface, and then exits the front surface. Then, in the light transmitting member, the front surface is composed of a planar surface perpendicular to the optical axis, while the rear surface is composed of a predetermined light reflection controlling surface formed by adopting as a reference surface a paraboloid of revolution having a focal point at a position of plane symmetry with the predetermined point with respect to the front surface of the light transmitting member. Further, an annular region having the center at the optical axis in the front surface of the light transmitting member is mirror-finished. Then, in the annular region, the position of the outer peripheral edge is set to be near a position where the incident angle of the light having exited the light emitting element and reached the front surface of the light transmitting member is equal to a critical angle, while the position of the inner peripheral edge is set to be near a position where the light having exited the light emitting element and undergone internal reflection in the front surface of the light transmitting member enters a position immediately behind the outer peripheral edge of the annular region in the rear surface of the light transmitting member. Thus, the following operation effects are obtained.

That is, among the light having exited the light emitting element and reached the front surface of the light transmitting member, the light having reached a region located on the outer periphery side relative to the outer peripheral edge of the annular region undergoes internal reflection by total reflection in the region on the outer periphery side, then undergoes internal reflection again in the rear surface, and then exits forward relative to the lighting device through the region on the outer periphery side. Further, the light having reached the annular region in the front surface of the light transmitting member undergoes internal reflection in the annular region, then undergoes internal reflection again in the rear surface, and then exits forward relative to the lighting device through the region on the outer periphery side in the front surface. Furthermore, the light having reached a region located on the inner periphery side relative to the inner peripheral edge of the annular region in the front surface of the light transmitting member exits, directly, forward relative to the lighting device through the region on the inner periphery side.

Thus, in a state that almost the entirety of the light having exited the light emitting element and reached the front surface of the light transmitting member is utilized as forward illuminating light, the fraction of multiple reflection light (i.e., the light that undergoes internal reflection in the front surface of the light transmitting member, then undergoes internal reflection again in the rear surface, and then exits the front surface) in the forward illuminating light can be maximized.

Thus, in a light distribution pattern formed by the illuminating light emitted from the vehicle lighting device onto a virtual vertical screen located in front of the lighting device, the fraction of light distribution pattern formed as an aggregate of small light source images can be maximized. This realizes a light distribution pattern having a high center luminosity.

As such, according to the one or more embodiments of the present invention, in a vehicle lighting device constructed such that light emitted from a light emitting element exits forward relative to the lighting device by means of a light transmitting member arranged on the front side of the lighting device, a light distribution pattern having a high center luminosity can be formed with a satisfactorily high utilization factor of the source light flux.

In the configuration described above, the detailed configuration of the region located on the inner periphery side relative to the inner peripheral edge of the annular region in the front surface of the light transmitting member is not limited to a particular one. However, when the region on the inner periphery side has a lens function of deflecting the outgoing light having exited the light emitting element and reached the region, a darker and larger light distribution pattern can easily be formed in an arbitrary size around a brighter and smaller light distribution pattern formed by the light having undergone internal reflection in the rear surface of the light transmitting member. Thus, the light distribution pattern formed by the illuminating light emitted from the vehicle lighting device can be formed in the shape of a light distribution pattern having a suppressed light distribution non-uniformity.

Alternatively, in place of this configuration, a space part that surrounds the light emitting element may be formed on the inner periphery side of the rear surface in the light transmitting member. Then, the front end surface of the space part may be formed in an approximately semi-spherical shape having the center at the predetermined point. Further, the region located near the optical axis in the front end surface may be composed of a convex surface protruding rearward. Even in this case, a darker and larger light distribution pattern can easily be formed in an arbitrary size around a brighter and smaller light distribution pattern formed by the light having undergone internal reflection in the rear surface of the light transmitting member. Thus, the light distribution pattern formed by the illuminating light emitted from the vehicle lighting device can be formed in the shape of a light distribution pattern having a suppressed light distribution non-uniformity.

In the configuration described above, when the light emitting element has a horizontally elongated light emitting chip, the light distribution pattern formed by the illuminating light emitted from the vehicle lighting device can easily be formed in the shape of a horizontally elongated light distribution pattern. Thus, the road surface ahead of a vehicle can easily be illuminated widely.

Other aspects and advantages of the invention will be apparent from the following description, the drawings and the claims.

DETAILED DESCRIPTION OF THE EXEMPLARY EMBODIMENTS

An exemplary embodiment of the present invention is described below with reference to the drawings.

Figure 1:
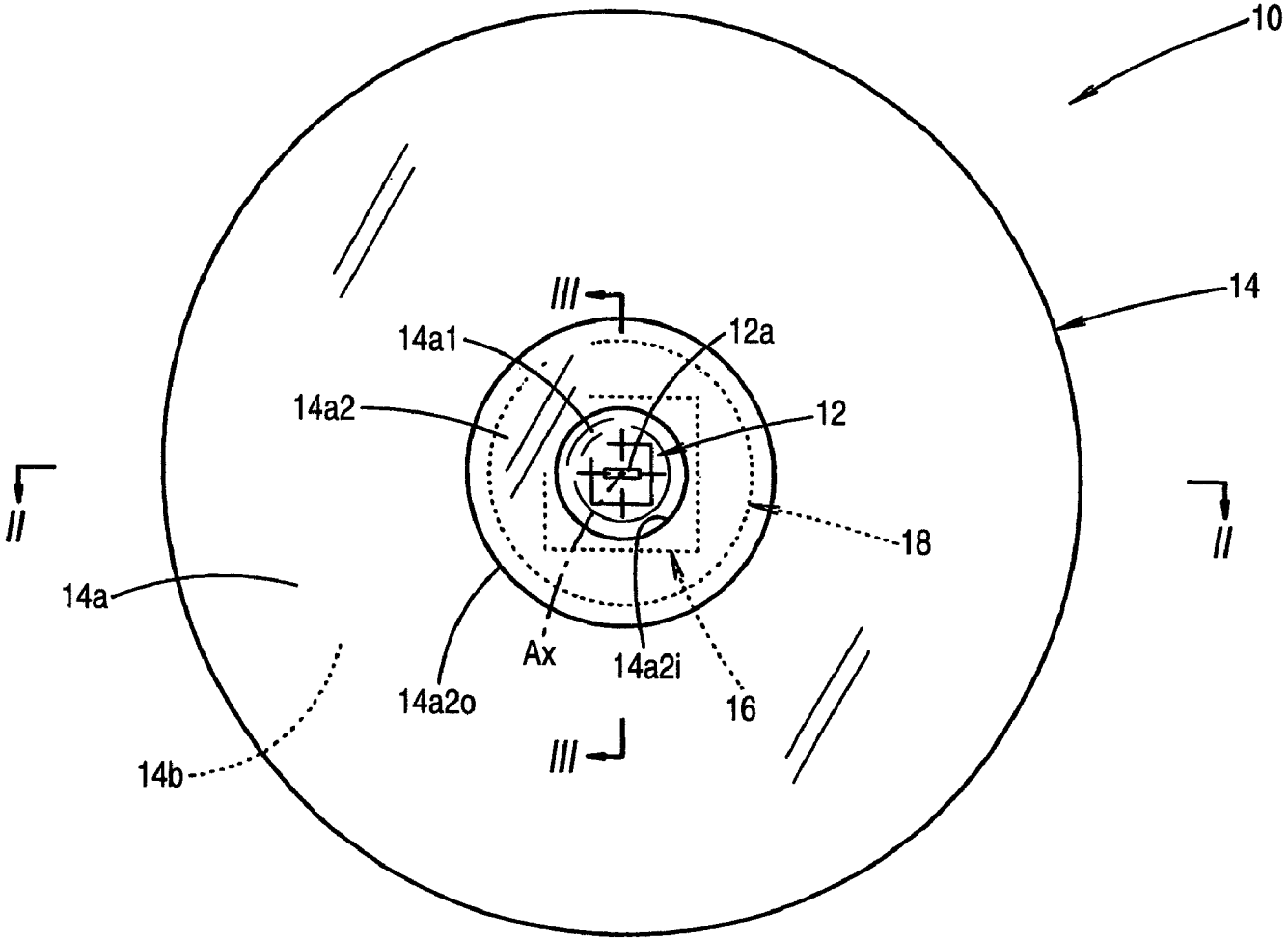
FIG. 1 is a front view showing a vehicle lighting device according to an embodiment of the present invention.
Figure 2:
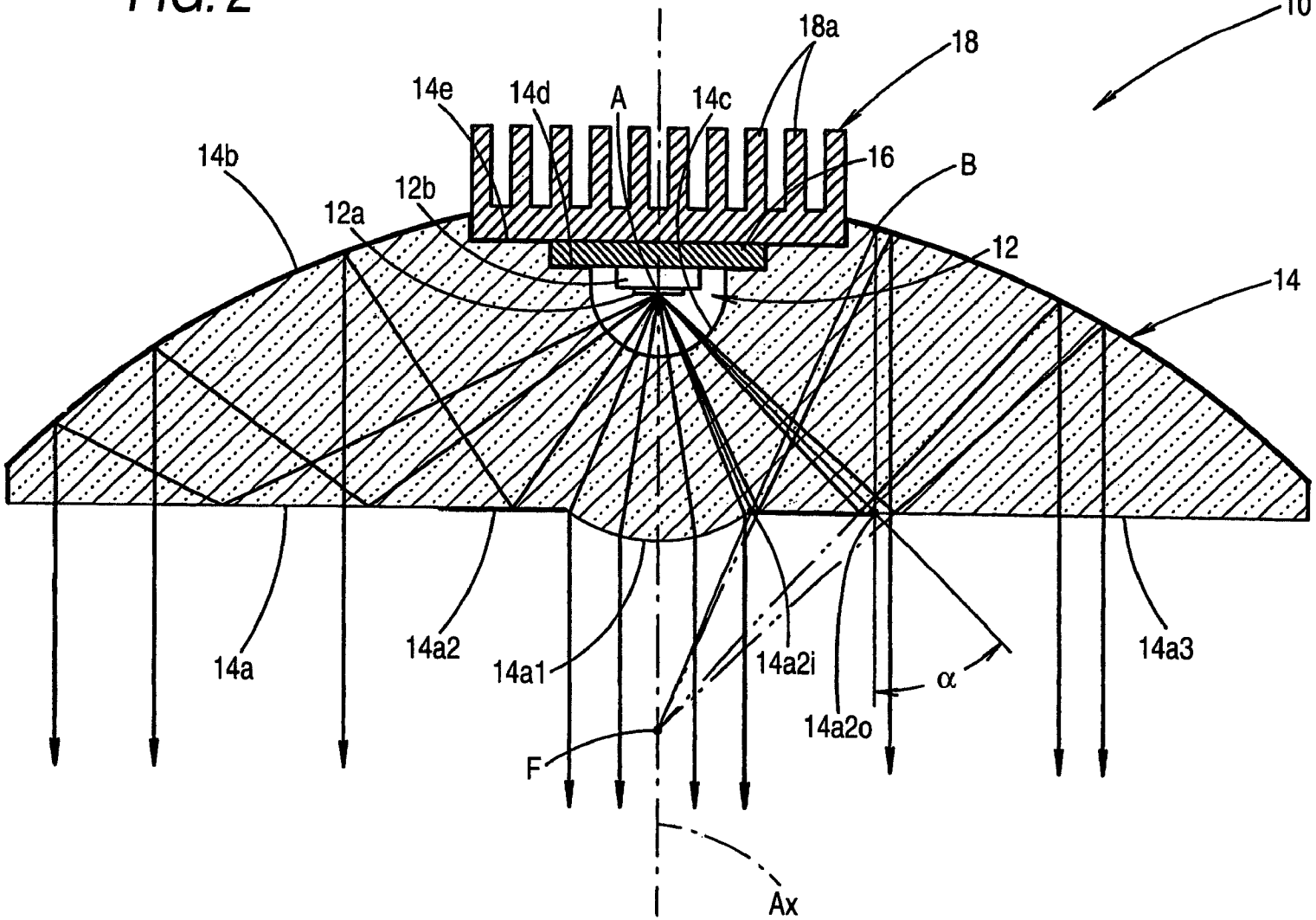
FIG. 2 is a sectional view taken along a line II-II in FIG. 1.
Figure 3:
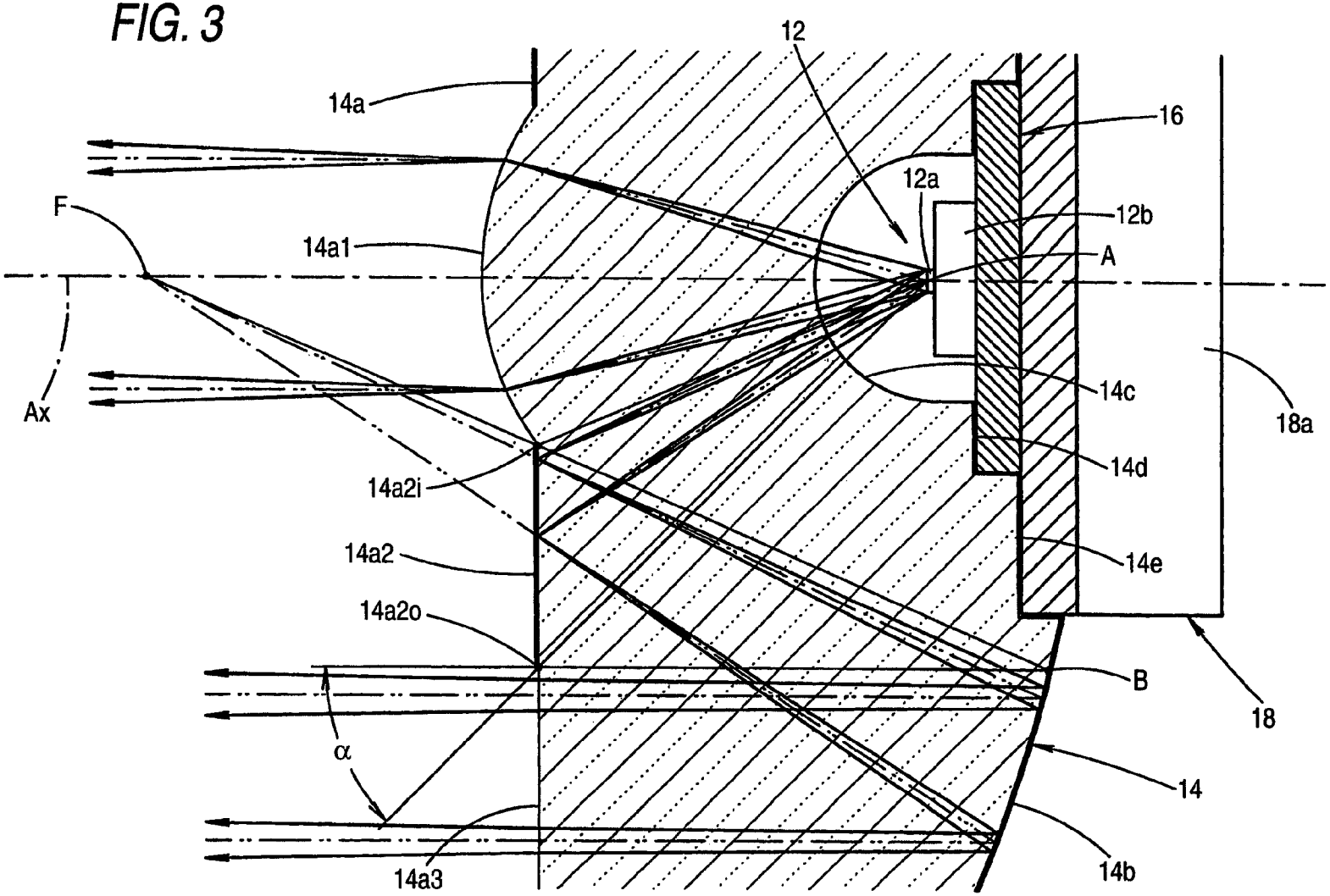
FIG. 3 is a detailed sectional view taken along a line III-III in FIG. 1.

FIG. 1 is a front view showing a vehicle lighting device 10 according to the present embodiment. FIG. 2 is a sectional view taken along a line II-II in FIG. 1. FIG. 3 is a detailed sectional view taken along a line III-III in FIG. 1.

As shown in these figures, the vehicle lighting device 10 according to the present embodiment has: a light emitting element 12 arranged in the forward direction on the optical axis Ax extending in the forward and backward directions of the lighting device; a light transmitting member 14 arranged on the front side of the lighting device relative to the light emitting element 12; a metal-made support plate 16 for supporting the light emitting element 12; and a metal-made heat sink 18 fixed to the rear surface of the support plate 16.

Then, the vehicle lighting device 10 is used in a state of being installed together with other vehicle lighting devices (not shown) into a lamp body (not shown) or the like in a manner permitting optical axis adjustment. Then, in a state that optical axis adjustment has been completed, the optical axis Ax extends in the forward and backward directions of the vehicle.

The light emitting element 12 has: a light emitting chip 12*a* composed of a white light diode and having a light emitting surface of horizontally elongated rectangular shape (specifically, of rectangular shape of vertical 1 mm by horizontal 4 mm or the like); and a substrate 12*b* for supporting the light emitting chip 12*a*. At that time, the light emitting chip 12*a* of the light emitting element 12 is sealed by a thin film formed such as to cover the light emitting surface. Then, the light emitting element 12 is arranged such that the center of the light emitting surface of the light emitting chip 12*a* (simply referred to as a "light emission center", hereinafter) is located at a predetermined point A on the optical axis Ax.

The light transmitting member 14 is composed of a transparent synthetic-resin molded articles such as an acrylic-resin molded article. Then, light emitted from the light emitting element 12 enters the light transmitting member 14, then undergoes internal reflection in the front surface 14*a*, then undergoes internal reflection again in the rear surface 14*b*, and then exits forward relative to the lighting device through the front surface 14*a*.

In the front surface 14*a* of the light transmitting member 14, the region other than the near-the-optical axis region 14*a*1 is composed of a planar surface perpendicular to the optical axis Ax. On the other hand, the rear surface 14*b* of the light transmitting member 14 is composed of a paraboloid of revolution that has a focal point F at a position of plane symmetry with the predetermined point A with respect to the front surface 14*a* and that has a center axis on the optical axis Ax. Then, the entirety of the rear surface 14*b* except for a region near the optical axis Ax is mirror-finished by aluminum vapor deposition or the like.

Further, the rear surface 14*b* of the light transmitting member 14 is formed such as to annularly surround the optical axis Ax. Then, on the inner periphery side of the rear surface 14*b*, a space part 14*c* is formed that surrounds the light emitting element 12 in the center. Further, a first recess 14*d* is formed in the circumference of the space part 14*c*, while a second recess 14*e* is formed in the circumference of the first recess 14*d*.

The front end surface of the space part 14*c* is formed in a semi-spherical shape having the center at the predetermined point A. Thus, the light emitted from the light emitting element 12 enters the light transmitting member 14 almost without refraction. In an exact description, the light emitted from the predetermined point A (i.e., the light emission center of the light emitting element 12) enters the light transmitting member 14 without refraction. Further, the first and the second recesses 14*d* and 14*e* have shapes in accordance with the shapes of the support plate 16 and the heat sink 18, and hence position these components. Here, in the heat sink 18, a plurality of heat radiation fins 18*a* are formed in the rear surface.

In the front surface 14*a* of the light transmitting member 14, an annular region 14*a*2 adjacent on the outer periphery side of the near-the-optical axis region 14*a*1 is mirror-finished by aluminum vapor deposition or the like.

The position of the outer peripheral edge 14*a*2*o* of the annular region 14*a*2 is set to be near a position where the incident angle of the light having exited the light emitting element 12 and reached the front surface 14*a* of the light transmitting member 14 is equal to a critical angle $\alpha$. In an exact description, the position of the outer peripheral edge 14*a*2*o* is set to be a position where the incident angle of the light having been exited the predetermined point A and reached the front surface 14*a* of the light transmitting member 14 is equal to the critical angle $\alpha$.

By virtue of this, in the annular region 14*a*2, the light having exited the light emitting element 12 and reached the front surface 14*a* of the light transmitting member 14 undergoes internal reflection in the mirror-finished reflecting surface. In contrast, in the peripheral region 14*a*3 located on the outer periphery side relative to the outer peripheral edge 14*a*2*o* of the annular region 14*a*2, the light undergoes internal reflection by total reflection.

The position of the inner peripheral edge 14*a*2*i* of the annular region 14*a*2 is set to be near a position where the light having exited the light emitting element 12 and undergone internal reflection in the front surface 14*a* of the light transmitting member 14 enters a position B immediately behind the outer peripheral edge 14*a*2*o* of the annular region 14*a*2 in the rear surface 14*b*. In an exact description, the position of the inner peripheral edge 14*a*2*i* is set to be a position where the light having been exited the predetermined point A and undergone internal reflection in the front surface 14*a* of the light transmitting member 14 enters the position B immediately behind the outer peripheral edge 14*a*2*o* of the annular region 14*a*2 in the rear surface 14*b*.

The near-the-optical axis region 14*a*1 located on the inner periphery side relative to the inner peripheral edge of the annular region 14*a*2 in the front surface 14*a* of the light transmitting member 14 has a lens function of deflecting the outgoing light having exited the light emitting element 12 and reached the near-the-optical axis region 14*a*1. At that time, the near-the-optical axis region 14*a*1 is formed in a spherical shape such that the light having exited the light emitting element 12 and reached the near-the-optical axis region 14*a*1 should exit forward relative to the lighting device in the form of a light beam approximately parallel to the optical axis Ax. In an exact description, the near-the-optical axis region 14*a*1 is formed such that the light having exited the predetermined point A and reached the near-the-optical axis region 14*a*1 should exit forward relative to the lighting device in the form of a light beam parallel to the optical axis Ax.

In the vehicle lighting device 10 according to the present embodiment, as shown in FIG. 2, the rear surface 14*b* is composed of a paraboloid of revolution that has a focal point F at a position of plane symmetry with the predetermined point A and that has a center axis on the optical axis Ax. Thus, the light having exited the predetermined point A, then undergone internal reflection in the front surface 14*a* of the light transmitting member 14, and then undergone internal reflection again in the rear surface 14*b* reaches the front surface 14*a* in the form of a light beam parallel to the optical axis Ax, and then exits forward relative to the lighting device through the front surface 14*a* in the intact form of a light beam parallel to the optical axis Ax. Further, the light having exited the predetermined point A and then directly exited forward relative to the lighting device through the near-the-optical axis region 14*a*1 in the front surface 14*a* of the light transmitting member 14 has also the form of a light beam parallel to the optical axis Ax as described above.

Actually, the light emitting surface of the light emitting chip 12*a* has a finite size. Thus, as shown in FIG. 3, the light emitted from the front surface 14*a* of the light transmitting member 14 is a light beam having a finite spread. At that time, the spread of the multiple reflection light (i.e., the light emitted after the multiple reflection in the front surface 14*a* and the rear surface 14*b* of the light transmitting member 14) is remarkably smaller than that of the light (referred to as "directly emitted light", hereinafter) directly emitted from the near-the-optical axis region 14*a*1 in the front surface 14*a* of the light transmitting member 14.

Figure 4:
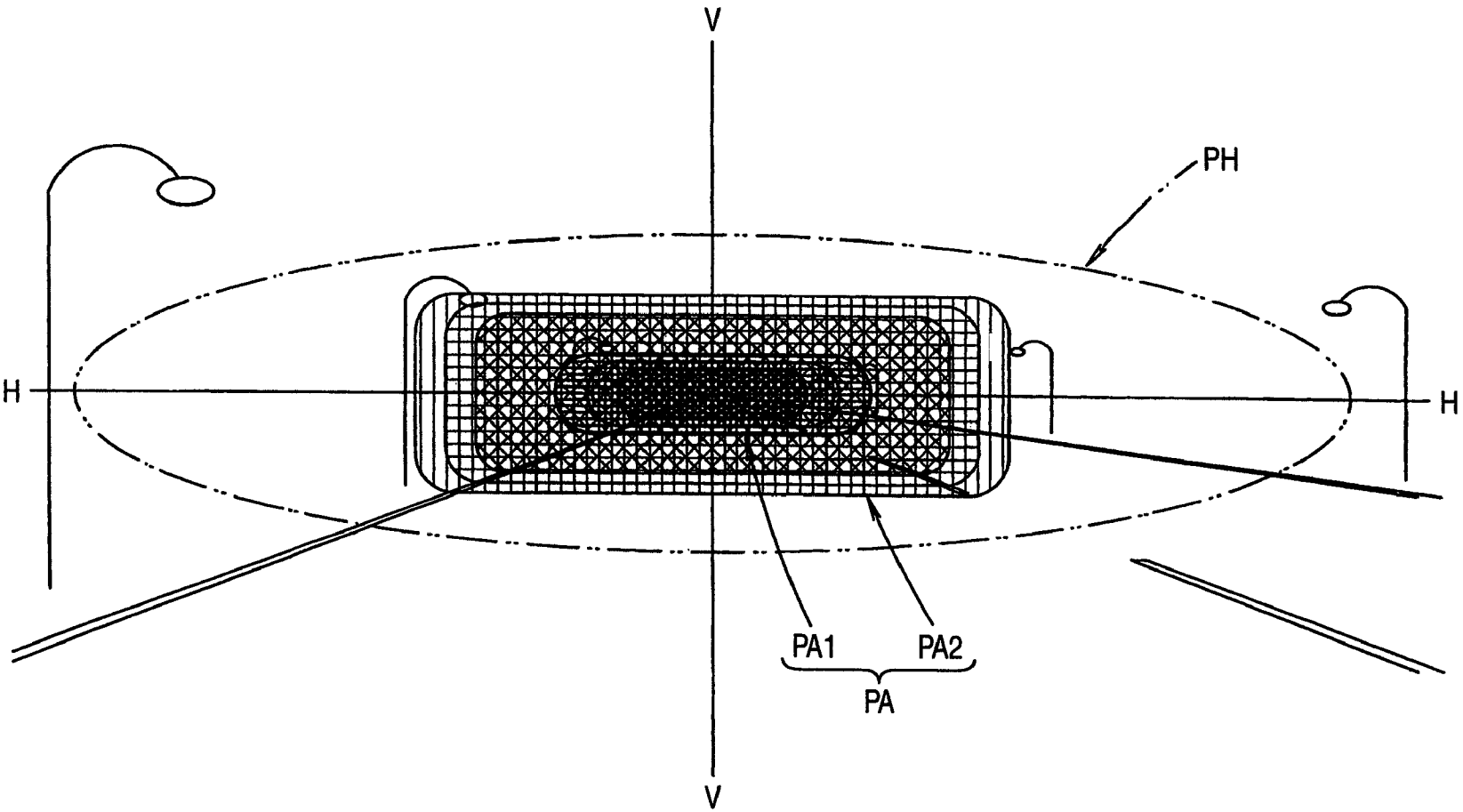
FIG. 4 is a see-through view showing a light distribution pattern formed by light projected forward from the above-mentioned vehicle lighting device onto a virtual vertical screen located at a position 25-m ahead of the lighting device.

FIG. 4 is a see-through view showing a light distribution pattern PA formed by light projected forward from the vehicle lighting device 10 according to the present embodiment onto a virtual vertical screen located at a position 25-*m* ahead of the lighting device.

As shown in the figure, the light distribution pattern PA is formed as a part of a high-beam light distribution pattern PH indicated by a two-dot chain line.

That is, the high-beam light distribution pattern PH is formed as a composite light distribution pattern consisting of the light distribution pattern PA and a light distribution pattern formed by light projected forward from another vehicle lighting device (not shown).

The high-beam light distribution pattern PH is formed around the H-V which is a vanishing point in the forward direction of the lighting device in the shape of a horizontally elongated light distribution pattern that extends widely on the right and left sides of the V-V line which is a vertical line that passes the H-V. Further, the light distribution pattern PA is formed in the shape of a horizontally elongated light distribution pattern that has a finite amount of spread on the right and left sides of the V-V line around the H-V.

The light distribution pattern PA is formed as a composite light distribution pattern consisting of two light distribution patterns PA1 and PA2 which have mutually different sizes.

The smaller light distribution pattern PA1 is a light distribution pattern formed by the multiple reflection light. On the other hand, the larger light distribution pattern PA2 is a light distribution pattern formed by directly emitted light.

At that time, the fact that the light distribution pattern PA1 is formed in the shape of a light distribution pattern remarkably smaller than the light distribution pattern PA2 is attributed to the difference in the spreads of the light at the time of being emitted from the front surface 14*a* of the light transmitting member 14 as described above (i.e., the multiple reflection light has a smaller spread than the directly emitted light).

Further, the fact that each of the light distribution patterns PA1 and PA2 is formed in the shape of a horizontally elongated light distribution pattern is attributed to the fact that the light emitting chip 12*a* of the light emitting element 12 has a horizontally elongated light emitting surface. At that time, the light distribution pattern PA2 is formed by the light having exited without reflection, and hence has a shape similar to the horizontally elongated rectangular shape of the light emitting surface of the light emitting chip 12*a*. In contrast, the light distribution pattern PA1 is formed by the light having exited after the two times of reflection, and hence has a shape similar to a cocoon shape obtained by slightly deforming the shape of the light emitting surface of the light emitting chip 12*a*.

Here, in each of the light distribution patterns PA1 and PA2, a plurality of curves formed approximately concentrically to the curve representing the outline are equi-intensity curves of light. These curves show that in the light distribution patterns PA1 and PA2, it goes gradually brighter with moving from the outer periphery to the center.

The light distribution pattern PA1 is formed as a brighter and smaller light distribution pattern. On the other hand, the light distribution pattern PA2 is formed as a light distribution pattern darker and larger than the light distribution pattern PA1. Thus, as the entirety of the light distribution pattern PA, a light distribution pattern is obtained that has a suppressed light distribution non-uniformity.

As described above in detail, the vehicle lighting device 10 according to the present embodiment is constructed such that light emitted from a light emitting element 12 that is arranged near a predetermined point A on the optical axis Ax extending in the forward and backward directions of the lighting device and that is directed in the forward direction of the lighting device enters a light transmitting member 14 arranged on the front side of the lighting device relative to the light emitting element 12, then undergoes internal reflection in the front surface 14*a*, then undergoes internal reflection again in the rear surface 14*b*, and then exits the front surface 14*a*. Then, in the light transmitting member 14, the front surface 14*a* is composed of a planar surface perpendicular to the optical axis Ax, while the rear surface 14*b* is composed of a predetermined light reflection controlling surface formed by adopting as a reference surface a paraboloid of revolution having a focal point at a position of plane symmetry with the predetermined point A with respect to the front surface 14*a* of the light transmitting member 14. Further, an annular region

14*a*2 having the center at the optical axis Ax in the front surface 14*a* of the light transmitting member 14 is mirror-finished. Then, in the annular region 14*a*2, the position of the outer peripheral edge 14*a*2*o* is set to be near a position where the incident angle of the light having exited the light emitting element 12 and reached the front surface 14*a* of the light transmitting member 14 is equal to a critical angle α, while the position of the inner peripheral edge 14*a*2*i* is set to be near a position where the light having exited the light emitting element 12 and undergone internal reflection in the front surface 14a of the light transmitting member 14 enters a position B immediately behind the outer peripheral edge 14*a*2*o* of the annular region 14*a*2 in the rear surface 14*b* of the light transmitting member. Thus, the following operation effects are obtained.

That is, among the light having exited the light emitting element 12 and reached the front surface 14*a* of the light transmitting member 14, the light having reached a peripheral region 14*a*3 located on the outer periphery side relative to the outer peripheral edge 14*a*2*o* of the annular region 14*a*2 undergoes internal reflection by total reflection in the peripheral region 14*a*3, then undergoes internal reflection again in the rear surface 14*b*, and then exits forward through the peripheral region 14*a*3. Further, the light having reached the annular region 14*a*2 in the front surface 14*a* of the light transmitting member 14 undergoes internal reflection in the annular region 14*a*2, then undergoes internal reflection again in the rear surface 14*b*, and then exits forward through the peripheral region 14*a*3 in the front surface 14*a*.

Furthermore, the light having reached the near-the-optical axis region 14*a*1 located on the inner periphery side relative to the inner peripheral edge 14*a*2*i* of the annular region 14*a*2 in the front surface 14*a* of the light transmitting member 14 exits, directly, forward through the near-the-optical axis region 14*a*1.

Thus, in a state that almost the entirety of the light having exited the light emitting element 12 and reached the front surface 14*a* of the light transmitting member 14 is utilized as forward illuminating light, the fraction of the multi reflection light in the forward illuminating light can be maximized.

Thus, in a light distribution pattern formed by the illuminating light emitted from the vehicle lighting device 10 onto a virtual vertical screen located in front of the lighting device, the fraction of light distribution pattern formed as an aggregate of small light source images can be maximized. This realizes a light distribution pattern PA having a high center luminosity.

As such, according to the present embodiment, in a vehicle lighting device 10 constructed such that light emitted from a light emitting element 12 should exit forward relative to the lighting device by means of a light transmitting member 14 arranged on the front side of the lighting device relative to the light emitting element 12, a light distribution pattern PA having a high center luminosity can be formed with a satisfactorily high utilization factor of the source light flux.

Further, in the vehicle lighting device 10 according to the present embodiment, the near-the-optical axis region 14*a*1 located on the inner periphery side relative to the inner peripheral edge 14*a*2*i* of the annular region 14*a*2 in the front surface 14*a* of the light transmitting member 14 has a lens function of deflecting the outgoing light having exited the light emitting element 12 and reached the near-the-optical axis region 14*a*1. Thus, a darker and larger light distribution pattern PA2 can easily be formed in an arbitrary size around a brighter and smaller light distribution pattern PA1 formed by the light having undergone internal reflection in the rear surface 14*b* of the light transmitting member 14. Thus, the light distribution pattern PA formed by the illuminating light emitted from the vehicle lighting device 10 can be formed in the shape of a light distribution pattern having a suppressed light distribution non-uniformity.

Further, in the vehicle lighting device 10 according to the present embodiment, the light emitting element 12 has a horizontally elongated light emitting chip 12*a*. Thus, the light distribution pattern PA formed by the illuminating light emitted from the vehicle lighting device 10 can easily be formed in the shape of a horizontally elongated light distribution pattern. Thus, the road surface ahead of a vehicle can be illuminated widely.

In particular, in the light distribution pattern PA obtained by the present embodiment, the brighter and smaller light distribution pattern PA1 forms near the H-V a horizontally elongated hot zone of the high-beam light distribution pattern PH so that visibility is improved for a distant region in the road surface ahead of a vehicle. Simultaneously, the light distribution pattern PA2 formed such as to surround the light distribution pattern PA1 satisfactorily improves the visibility of the peripheral region.

The embodiment given above has been described for a case that the light emitting chip 12*a* of the light emitting element 12 has a light emitting surface of horizontally elongated rectangular shape. In place of this, a plurality of light emitting chips 12*a* each having a square light emitting surface may horizontally be arranged closely to each other.

Further, the embodiment given above has been described for a case that the rear surface 14*b* of the light transmitting member 14 is composed of a paraboloid of revolution. However, this paraboloid of revolution may have a diffusion deflection function.

Next, modifications to the embodiment given above are described below.

A first modification to the embodiment given above is described first.

Figure 5:
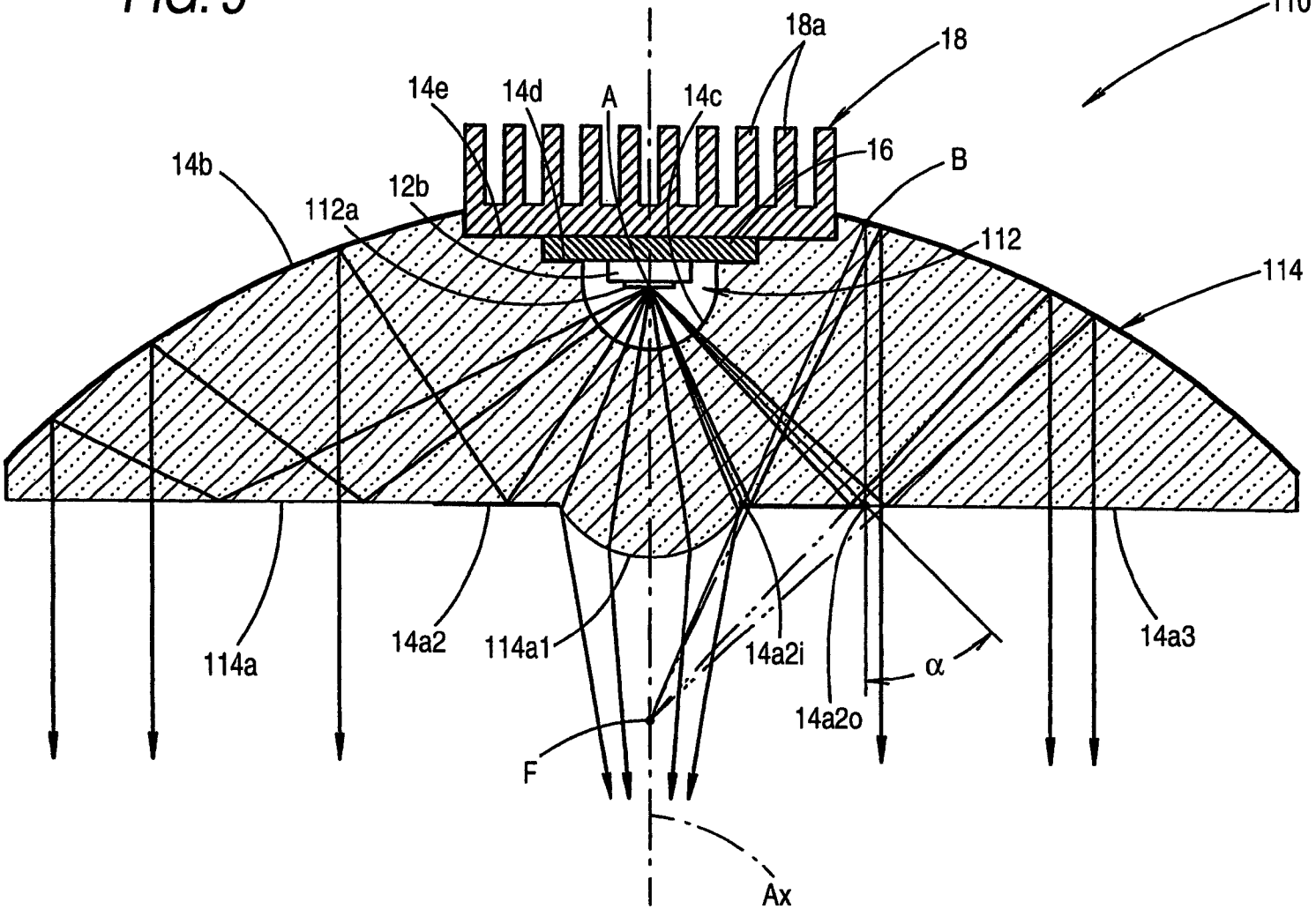
FIG. 5 is a diagram showing a vehicle lighting device according to a first modification to the above-mentioned embodiment, illustrated in a manner similar to FIG. 2.
Figure 6:
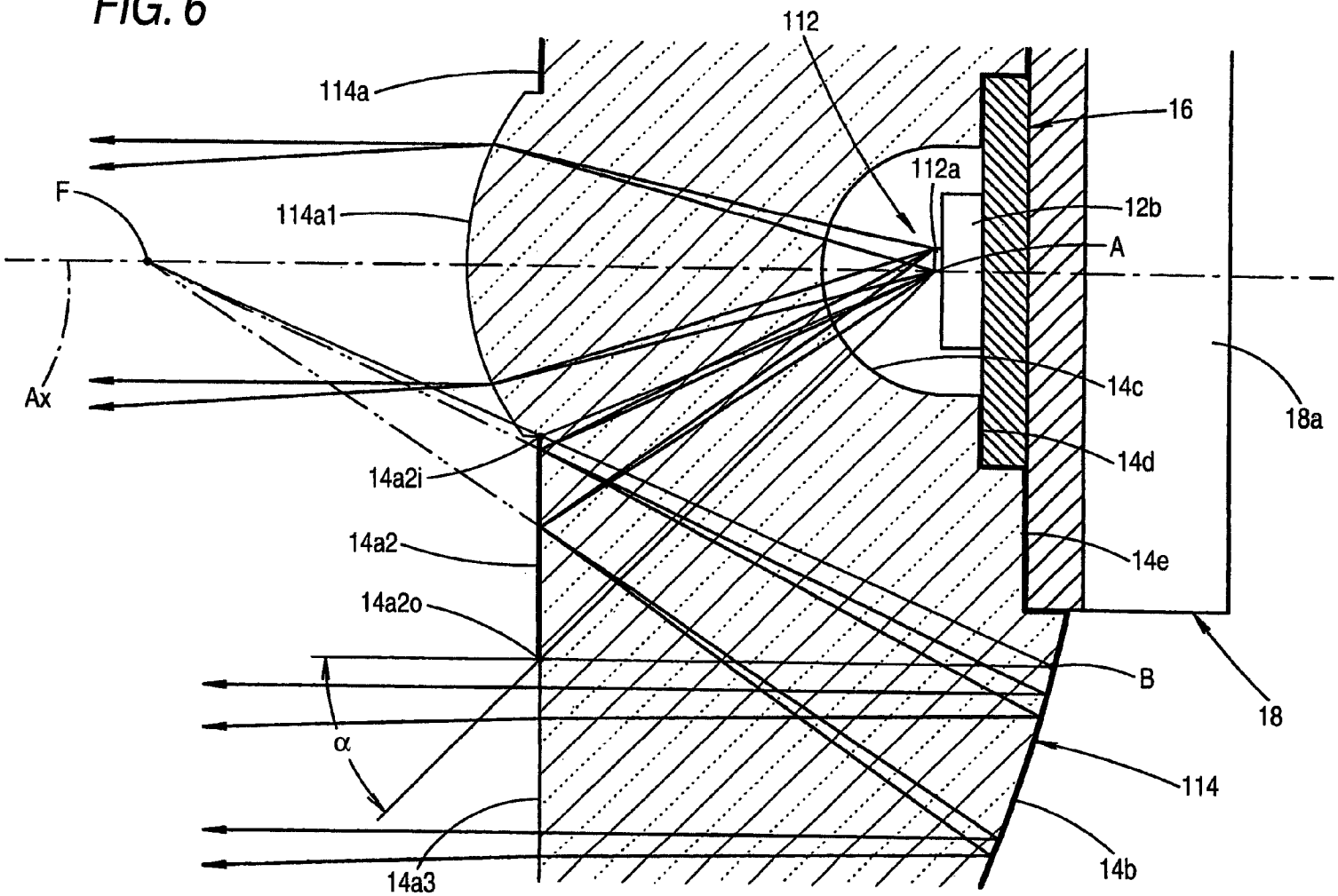
FIG. 6 is a diagram showing the vehicle lighting device according to the first modification, illustrated in a manner similar to FIG. 3.

FIGS. 5 and 6 are diagrams showing a vehicle lighting device 110 according to the present modification, illustrated in a manner similar to FIGS. 2 and 3.

As shown in these figures, the basic configuration of the vehicle lighting device 110 according to the present modification is similar to that of the embodiment given above. However, the position of the light emitting chip 112*a* in the light emitting element 112 and the surface shape of the near-the-optical axis region 114*a*1 in the front surface 114a of the light transmitting member 114 are different from those of the embodiment given above. Here, in the vehicle lighting device 110 according to the present modification, like parts to those of the vehicle lighting device 10 according to the embodiment given above are designated by like reference numerals, and hence their description is omitted.

In the light emitting chip 112*a* in the light emitting element 112 according to the present modification, the shape itself is similar to that of the light emitting chip 12*a* in the light emitting element 12 of the embodiment given above. However, the light emitting chip 112*a* is arranged at a position slightly displaced upward from the center of the substrate 12*b* in contrast to the embodiment given above where the light emitting chip 12*a* is located in the center of the substrate 12*b*. Then, similarly to the light emitting element 12 of the embodiment given above, the light emitting element 112 is arranged in the forward direction on the optical axis Ax. Then, in this state, the lower edge of the light emitting chip 112*a* is located in a horizontal plane that contains the optical axis Ax. At that time, the predetermined point A is located at the center of the right and left directions on the lower edge of the light emitting chip 112*a*.

In the near-the-optical axis region 114*a*1 in the front surface 114*a* of the light transmitting member 114 according to the present modification, the surface shape is not spherical in contrast to the near-the-optical axis region 14*a*1 of the embodiment given above. That is, the surface shape is of spherical ellipse in which the curvature of the horizontal section is greater than that of the vertical cross section. Thus, in the front surface 114*a* of the light transmitting member 114, a small level difference is formed along the inner peripheral edge 14*a*2*i* of the annular region 14*a*2 between the near-the-optical axis region 114*a*1 and the annular region 14*a*2, except for the left and right end edge points of the near-the-optical axis region 114*a*1.

Then, in the near-the-optical axis region 114*a*1, the light having exited the light emitting element 112 and reached the near-the-optical axis region 114*a*1 exits forward relative to the lighting device in the form of an approximately parallel light beam directed slightly downward, in the up and down directions. In the horizontal directions, the light exits forward relative to the lighting device in the form of a light beam once converging toward the optical axis Ax and then diffusing horizontally.

At that time, in the light emitted from the near-the-optical axis region 114*a*1, as shown in FIG. 6, in the up and down directions, the light emitted from the lower edge of the light emitting chip 112*a* forms a light beam parallel to the optical axis Ax, while the light emitted from the other part of the light emitting chip 112*a* forms a light beam directed downward relative to the optical axis Ax.

Further, also in the multiple reflection light (i.e., the light emitted after the multiple reflection in the front surface 114*a* and the rear surface 14*b* of the light transmitting member 114), as shown in FIG. 6, in the up and down directions, the light emitted from the lower edge of the light emitting chip 112*a* forms a light beam parallel to the optical axis Ax, while the light emitted from the other part of the light emitting chip 112*a* forms a light beam directed downward relative to the optical axis Ax.

At that time, the spread of the multiple reflection light is remarkably small than that of the directly emitted light (i.e., the light directly emitted from the near-the-optical axis region 114*a*1 in the front surface 114*a* of the light transmitting member 114). This situation is similar to that in the embodiment given above.

In the vehicle lighting device 110 according to the present modification, in a state that optical axis adjustment has been completed, the optical axis Ax extends in a forward direction of the frontward and backward directions of the vehicle, in a downward direction by approximately 0.5 to 0.6 degree.

Figure 7:
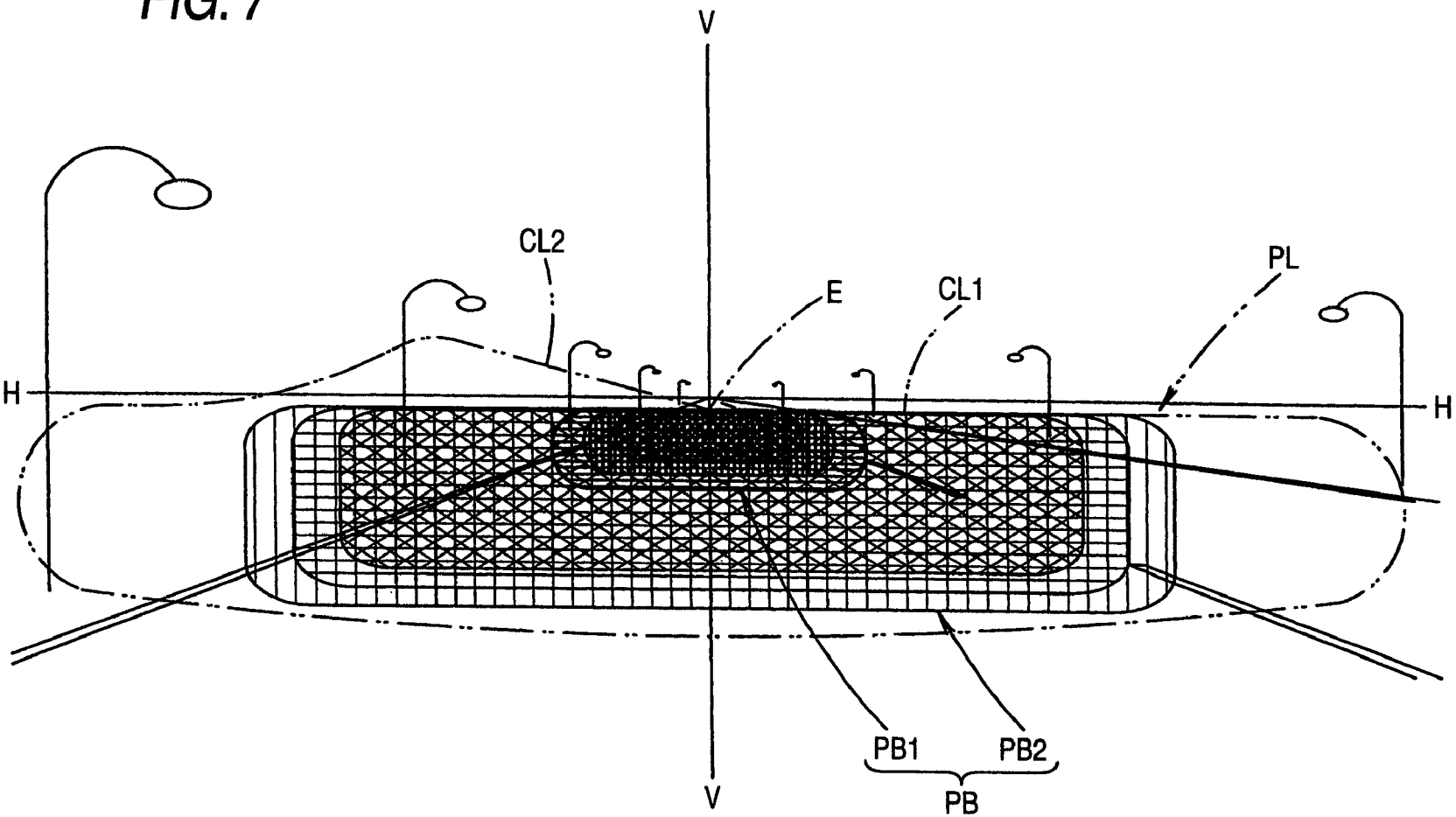
FIG. 7 is a see-through view showing a light distribution pattern formed by light projected forward from the vehicle lighting device according to the first modification onto a virtual vertical screen.

FIG. 7 is a see-through view showing a light distribution pattern PB formed by light projected forward from the vehicle lighting device 110 according to the present modification onto a virtual vertical screen located at a position 25-*m* ahead of the lighting device.

As shown in the figure, the light distribution pattern PB is formed as a part of a low-beam light distribution pattern PL indicated by a two-dot chain line.

That is, the low-beam light distribution pattern PL is formed as a composite light distribution pattern consisting of the light distribution pattern PB and a light distribution pattern formed by light projected forward from another vehicle lighting device (not shown).

The low-beam light distribution pattern PL is a low-beam light distribution pattern of left light distribution, and has horizontal and inclined cutoff lines CL1 and CL2 in the upper end part. At that time, the horizontal cutoff line CL1 is formed on the opposite lane side relative to the V-V line, while the inclined cutoff line CL2 is formed on the own lane side. Then, an elbow point E which is the intersecting point between the cutoff lines CL1 and CL2 is located at approximately 0.5 to 0.6 degree below the H-V which is the vanishing point in the forward direction of the lighting device.

The light distribution pattern PB is formed in the shape of a horizontally elongated light distribution pattern that extends widely on the right and left sides of the V-V line under the two cutoff lines CL1 and CL2.

The light distribution pattern PB is formed as a composite light distribution pattern consisting of two light distribution patterns PB1 and PB2 which have mutually different sizes.

The smaller light distribution pattern PB1 is a light distribution pattern formed by the multiple reflection light. On the other hand, the larger light distribution pattern PB2 is a light distribution pattern formed by directly emitted light.

At that time, the light distribution pattern PB1 is formed in almost the same shape and size as those of the light distribution pattern PA1 of the embodiment given above. Further, the upper edge is located at the same height as the horizontal cutoff line CL1. Furthermore, as for the luminosity distribution, the luminosity is increasing with approaching the upper edge.

This is because the light emitting element 112 is arranged such that the lower edge of the light emitting chip 112*a* is located in a horizontal plane that contains the optical axis Ax, and because the optical axis Ax of the vehicle lighting device 110 extends forward in the forward and backward directions of the vehicle, in a downward direction by approximately 0.5 to 0.6 degree.

On the other hand, the light distribution pattern PB2 is formed in a shape and a size obtained by horizontally expanding the light distribution pattern PA2 of the embodiment given above. Further, the upper edge is located at the same height as the horizontal cutoff line CL1. Furthermore, as for the luminosity distribution, the luminosity is increasing with approaching the upper edge.

The fact that the left and right diffusion angle of the light distribution pattern PB2 is larger than that of the light distribution pattern PA2 of the embodiment given above is attributed to the fact that the near-the-optical axis region 114*a*1 in the front surface 114*a* of the light transmitting member 114 according to the present modification is constructed such that the light having exited the light emitting element 112 and reached the near-the-optical axis region 114*a*1 should diffuse horizontally.

Further, in the light distribution pattern PB2, the fact that the upper edge is located at the same height as the horizontal cutoff line CL1 and that the luminosity is increasing with approaching the upper edge is attributed to the above-mentioned fact that the lower edge of the light emitting chip 112*a* of the light emitting element 112 is located on the horizontal plane that contains the optical axis Ax and that the optical axis Ax extends in a downward direction by approximately 0.5 to 0.6 degree.

In the light distribution pattern PB obtained by the present modification, the light distribution pattern PB1 is formed as a brighter and smaller light distribution pattern. On the other hand, the light distribution pattern PB2 is formed as a light distribution pattern darker and larger than the light distribution pattern PB1. Thus, in the entirety, a light distribution pattern is obtained that has a suppressed light distribution non-uniformity.

According to the present modification, the brighter and smaller light distribution pattern PB1 in the light distribution pattern PB illuminates brightly the vicinity under of the elbow point E in the low-beam light distribution pattern PL so that visibility is improved for a distant region in the road surface ahead of a vehicle. Further, the light distribution pattern PB1 to the light distribution pattern PB1 that extends toward the right and left sides and the near side illuminates the peripheral region widely so that overall visibility is improved for the road surface ahead of the vehicle.

Next, a second modification to the embodiment given above is described below.

Figure 8:
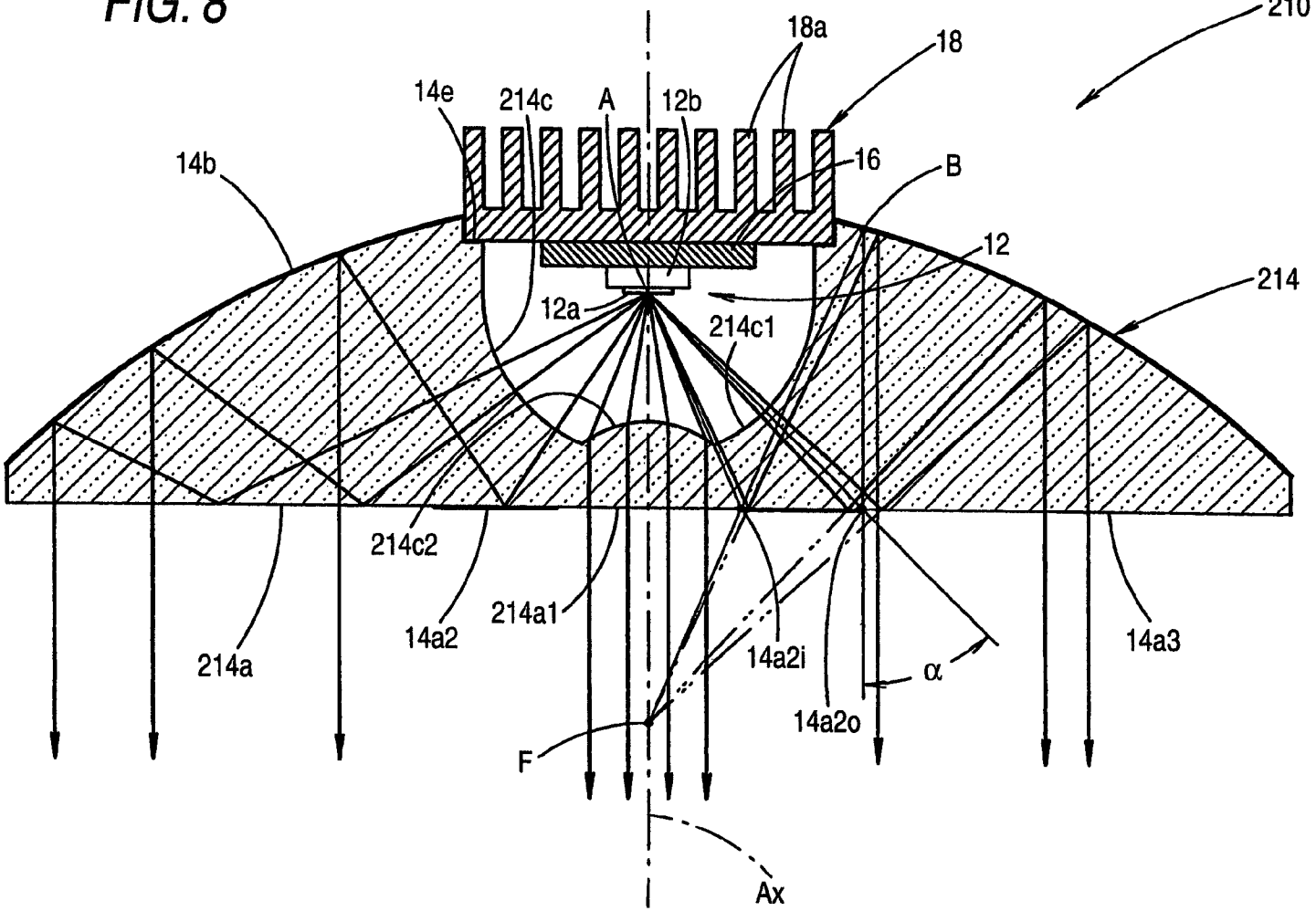
FIG. 8 is a diagram showing a vehicle lighting device according to a second modification to the above-mentioned embodiment, illustrated in a manner similar to FIG. 2.

FIG. 8 is a diagram showing a vehicle lighting device 210 according to the present modification, illustrated in a manner similar to FIG. 2.

As shown in the figure, the basic configuration of the vehicle lighting device 210 according to the present modification is similar to that of the embodiment given above. However, the surface shape of the near-the-optical axis region 214*a*1 in the front surface 214*a* of the light transmitting member 214 and the shape of the space part 214*c* are different from those of the embodiment given above. Here, in the vehicle lighting device 210 according to the present modification, like parts to those of the vehicle lighting device 10 according to the embodiment given above are designated by like reference numerals, and hence their description is omitted.

The near-the-optical axis region 214*a*1 in the front surface 214*a* of the light transmitting member 214 according to the present modification does not have a lens function similar to that of the near-the-optical axis region 14*a*1 of the embodiment given above. That is, the near-the-optical axis region 214*a*1 is formed in plane with the other region of the front surface 214*a* (that is, composed of a planar surface perpendicular to the optical axis Ax).

On the other hand, the space part 214*c* in the light transmitting member 214 according to the present modification is formed such as to surround the light emitting element 12 on the inner periphery side of the rear surface 14*b* in the light transmitting member 214 similarly to the space part 14 in the light transmitting member 14 of the embodiment given above.

Similarly to the front end surface of the space part 14 of the embodiment given above, the front end surface 2114cl of the space part 214*c* is formed in a semi-spherical shape having the center at the predetermined point A. However, the radius is set to be a value remarkably greater than that in the embodiment given above. Then, a region located near the optical axis Ax in the front end surface 214*c*1 is composed of a convex surface 214*c*2 protruding rearward.

The convex surface 214*c*2 is formed in a spherical shape serving as a lens surface for refracting the light having exited the light emitting element 12 and reached the convex surface 214*c*2, into a light beam approximately parallel to the optical axis Ax.

The outer peripheral edge of the convex surface 214*c*2 is set to be a position where the conic surface formed by the straight line that joins the predetermined point A and the inner peripheral edge 14*a*2*i* of the annular region 14*a*2 intersects the front end surface 214*c*1 of the space part 214*c*.

Thus, the light having exited the light emitting element 12 and reached the light transmitting member 214 on the outer periphery side relative to the conic surface is allowed to enter through the front end surface 214*c*1 of the space part 214*c* almost intact without refraction, and then undergoes internal reflection in the front surface 14*a*. On the other hand, the light having exited the light emitting element 12 and reached the light transmitting member 214 on the inner periphery side relative to the conic surface is refracted by the convex surface 214*c*2 into the form of a light beam approximately parallel to the optical axis Ax, and then exits forward through the near-the-optical axis region 214*a*1 of the front surface 214*a* in the intact form of a light beam approximately parallel to the optical axis Ax.

Also in the vehicle lighting device 210 according to the present modification, the light having reached the annular region 14*a*2 in the front surface 214*a* of the light transmitting member 214 or the peripheral region 14*a*3 located on the outer periphery side undergoes internal reflection, then undergoes internal reflection again in the rear surface 14*b*, and then exits forward through the front surface 214*a*. Thus, a light distribution pattern similar to the light distribution pattern PA is formed.

Further, also in the vehicle lighting device 210 according to the present modification, the light having exited the light emitting element 12 and reached the convex surface 214*c*2 of the light transmitting member 214 exits forward through the near-the-optical axis region 214*a*1 of the front surface 214*a* in the form of a light beam approximately parallel to the optical axis Ax. Thus, a light distribution pattern similar to the light distribution pattern PB is formed. Here, the convex surface 214*c*2 having a spherical shape that provides the lens function in the light transmitting member 214 according to the present modification has a shorter focal length than the near-the-optical axis region 14*a*1 having a spherical shape that provides the lens function in the light transmitting member 14 of the embodiment given above. Thus, a light distribution pattern slightly larger than the light distribution pattern PB is formed.

When the vehicle lighting device 210 according to the present modification is employed, the entirety of the front surface 214*a* of the light transmitting member 214 can be maintained in the shape of a planar surface. This simplifies the fabrication of the light transmitting member 214. Further, thickness reduction of the lighting device is achieved in comparison with the vehicle lighting device 10 according to the embodiment given above.

Here, the numerical values described as parameters in the embodiment and the modifications given above are merely examples. Thus, these parameters may have other appropriate values.

While description has been made in connection with specific embodiment and modifications of the present invention, it will be obvious to those skilled in the art that various changes and modification may be made therein without departing from the present invention. It is aimed, therefore, to cover in the appended claims all such changes and modifications falling within the true spirit and scope of the present invention.

DESCRIPTION OF REFERENCE NUMERALS AND SIGNS

10, 110, 210 Vehicle lighting device
12, 112 Light emitting element
12*a*, 112*a* Light emitting chip
12*b* Substrate
14, 114, 214 Light transmitting member
14*a*, 114*a*, 214*a* Front surface
14*a*1, 114*a*1, 214*a*1 Near-the-optical axis region
14*a*2 Annular region
14*a*2*i* Inner peripheral edge
14*a*2*o* Outer peripheral edge
14*a*3 Peripheral region
14*b* Rear surface
14*c* 214*c* Space part
14*d* First recess
14*e* Second recess

16 Support plate
18 Heat sink
18*a* Heat radiation fin
214*c*1 Front end surface
214*c*2 Convex surface
A Predetermined point
Ax Optical axis
B Position immediately behind outer peripheral edge
CL1 Horizontal cutoff line
CL2 Inclined cutoff line
E Elbow point
F Focal point
PA, PA1, PA2, PB, PB1, PB2 Light distribution pattern
PH High-beam light distribution pattern
PL Low-beam light distribution pattern

What is claimed is:

1. A vehicle lighting device comprising:

a light emitting element that is arranged in vicinity of a predetermined point on an optical axis extending in forward and backward directions of the lighting device and that directs in a forward direction of the lighting device; and a light transmitting member arranged on a front side of the lighting device relative to the light emitting element, wherein light emitted from the light emitting element enters the light transmitting member, the light which enters the light transmitting member is reflected by an internal reflection on a front surface of the light transmitting member, is subsequently reflected by an internal reflection on a rear surface of the light transmitting member, and exits the front surface of the light transmitting member after being reflected by the internal reflection on the rear surface of the light transmitting member, wherein the front surface of the light transmitting member comprises a planar surface perpendicular to the optical axis, wherein the rear surface of the light transmitting member is composed of a predetermined light reflection controlling surface formed by adopting, as a reference surface, a paraboloid of revolution having a focal point at a position of plane symmetry with the predetermined point with respect to the front surface of the light transmitting member, wherein an annular region having a center at the optical axis in the front surface of the light transmitting member is mirror-finished, wherein an outer peripheral edge of the annular region is positioned in a vicinity of a position where an incident angle of the light emitted from the light emitting element to the front surface of the light transmitting member is equal to a critical angle, and wherein an inner peripheral edge of the annular region is set in a vicinity of a position where the light which has exited the light emitting element and reflected by the internal reflection on the front surface of the light transmitting member enters a position immediately behind the outer peripheral edge of the annular region in the rear surface of the light transmitting member.

2. The vehicle lighting device according to claim 1, wherein a region located on an inner periphery side relative to the inner peripheral edge of the annular region in the front surface of the light transmitting member has a lens function of deflecting the outgoing light exited the light emitting element and reached the region.

3. The vehicle lighting device according to claim 1. wherein a space part that surrounds the light emitting element is formed on an inner periphery side of the rear surface in the light transmitting member, a front end surface of the space part is formed in an approximately semi-spherical shape having a center at the predetermined point, and a region located near the optical axis in the front end surface is composed of a convex surface protruding rearward.

4. The vehicle lighting device according to claim 1, wherein the light emitting element has a horizontally elongated light emitting chip.

5. The vehicle lighting device according to claim 1, wherein the entire front surface of the light transmitting member is a planar surface perpendicular to the optical axis.

6. The vehicle lighting device according to claim 1, wherein at least a part of the rear surface of the light transmitting member is disposed behind the light emitting element.

* * * * *